US012600592B2

(12) United States Patent
Shiraiwa et al.

(10) Patent No.: US 12,600,592 B2
(45) Date of Patent: Apr. 14, 2026

(54) MEDIUM EJECTION APPARATUS INCLUDING EJECTION TRAY FORMED WITH RECESSED PART AND BEAM PART

(71) Applicant: PFU LIMITED, Kahoku (JP)

(72) Inventors: Hiroshi Shiraiwa, Kahoku (JP); Yuki Takato, Kahoku (JP)

(73) Assignee: PFU LIMITED, Kahoku (JP)

( * ) Notice: Subject to any disclaimer, the term of this patent is extended or adjusted under 35 U.S.C. 154(b) by 98 days.

(21) Appl. No.: 18/306,008

(22) Filed: Apr. 24, 2023

(65) Prior Publication Data

US 2023/0391575 A1 Dec. 7, 2023

(30) Foreign Application Priority Data

Jun. 7, 2022 (JP) ..... 2022-092419

(51) Int. Cl.

| | |
|---|---|
| ***B65H 31/02*** | (2006.01) |
| ***B65H 29/12*** | (2006.01) |
| ***B65H 29/14*** | (2006.01) |
| ***B65H 31/10*** | (2006.01) |
| ***B65H 31/20*** | (2006.01) |

(52) U.S. Cl.

CPC ..... *B65H 29/14* (2013.01); *B65H 29/125* (2013.01); *B65H 31/02* (2013.01); *B65H 31/10* (2013.01); *B65H 31/20* (2013.01); *B65H 2601/523* (2013.01); *B65H 2801/03* (2013.01)

(58) Field of Classification Search

CPC ..... B65H 2405/111; B65H 2405/1111; B65H 2405/1112; B65H 2405/11131; B65H 2405/11162; B65H 2405/1117; B65H 2404/52131; B65H 2404/5214

See application file for complete search history.

(56) References Cited

U.S. PATENT DOCUMENTS 4,361,319 A * 11/1982 Ikeda ..... B65H 39/11 271/209
5,115,322 A * 5/1992 Jang ..... H04N 1/00679 346/24
5,175,583 A * 12/1992 Noh ..... G03G 15/6552 271/223

(Continued)

FOREIGN PATENT DOCUMENTS

JP 58144045 A * 8/1983
JP 2004-59180 A 2/2004

*Primary Examiner* — Luis A Gonzalez
(74) *Attorney, Agent, or Firm* — Womble Bond Dickinson (US) LLP

(57) ABSTRACT

A medium ejection apparatus includes a housing, an ejection roller, and an ejection tray attached to the housing to be able to rotate and having a first surface and a second surface, formed at a back side of the first surface, to stack the medium ejected by the ejection roller. The first surface and the second surface are formed by a single member. The first surface is formed with a first recessed part extending in a medium ejection direction and a first beam part extending in the medium ejection direction and sticking out from the first recessed part. The second surface is formed with a second recessed part extending in the medium ejection direction due to the first beam part and is formed with a second beam part extending in the medium ejection direction and sticking out from the second recessed part due to the first recessed part.

6 Claims, 12 Drawing Sheets

(56) References Cited

U.S. PATENT DOCUMENTS

| | | | | |
|---|---|---|---|---|
| 7,290,952 | B2 * | 11/2007 | Kagami | B65H 31/02<br>347/108 |
| 7,631,864 | B1 * | 12/2009 | Howe | B65H 31/02<br>271/209 |
| 2012/0061902 | A1 * | 3/2012 | Ino | B65H 31/26<br>271/265.01 |

* cited by examiner

MEDIUM EJECTION APPARATUS INCLUDING EJECTION TRAY FORMED WITH RECESSED PART AND BEAM PART

CROSS-REFERENCE TO RELATED APPLICATIONS

This application is based upon and claims the benefit of priority of prior Japanese Patent Application No. 2022-092419, filed on Jun. 7, 2022, the entire contents of which are incorporated herein by reference.

TECHNICAL FIELD

Embodiments described in the present specification relate to a medium ejection apparatus having a tray for stacking an ejected medium.

A scanner or other medium ejection apparatus conveys a medium while capturing its image and ejects it on to an ejection tray. In such a medium ejection apparatus, to support several types and sizes of the medium, it is required the several types or sizes of the medium be suitably stacked on the ejection tray.

An opening/closing type ejection stacker provided with a stacker body provided to be able to be opened and closed relative to a printer body and an extension stacker provided at the stacker body and extending the operating length of the stacker has been disclosed (see Japanese Unexamined Patent Publication No. 2004-59180). In this opening/closing type ejection stacker, the back surface of the extension stacker is provided with assist ribs assisting the smooth transport of paper ejected from the printer body, while the front surface of the stacker body is provided with reinforcing ribs with rib grooves cut into them for engagement with the assist ribs.

SUMMARY

According to some embodiments, a medium ejection apparatus includes a housing, an ejection roller to eject a medium, and an ejection tray attached to the housing to be able to rotate and having a first surface and a second surface, formed at a back side of the first surface, to stack the medium ejected by the ejection roller. The first surface and the second surface are formed by a single member. The first surface is formed with a first recessed part extending in a medium ejection direction and a first beam part extending in the medium ejection direction and sticking out from the first recessed part. The second surface is formed with a second recessed part extending in the medium ejection direction due to the first beam part and is formed with a second beam part extending in the medium ejection direction and sticking out from the second recessed part due to the first recessed part.

DESCRIPTION OF EMBODIMENTS

It is to be understood that both the foregoing general description and the following detailed description are exemplary and explanatory, and are not restrictive of the invention, as claimed.

Hereinafter, a medium ejection apparatus according to some embodiments will be described with reference to the drawings. However, it should be noted that the technical scope of the invention is not limited to these embodiments, and extends to the inventions described in the claims and their equivalents.

Figure 1:
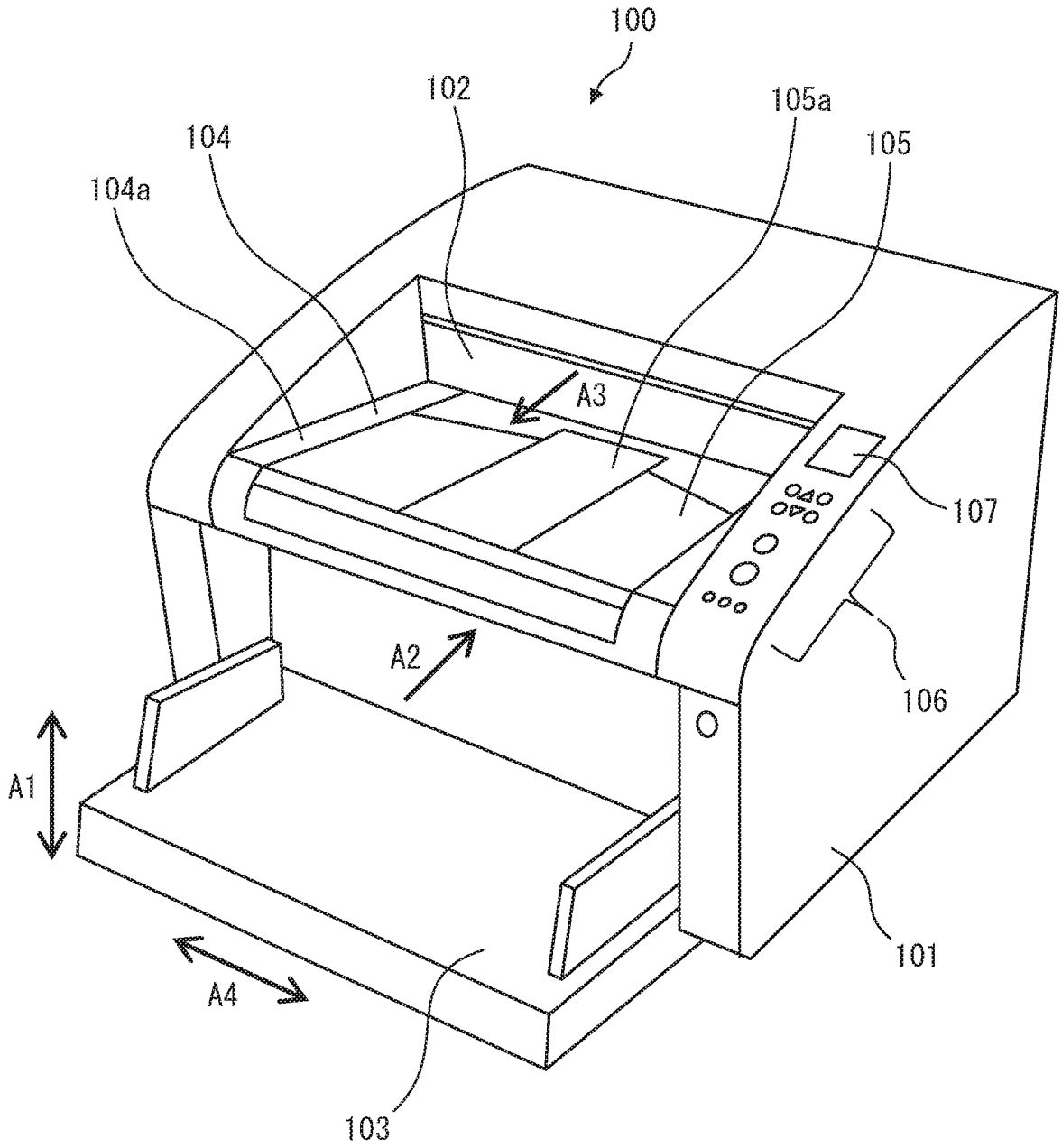
FIG. 1 is a perspective view showing a medium ejection apparatus 100.
Figure 2:
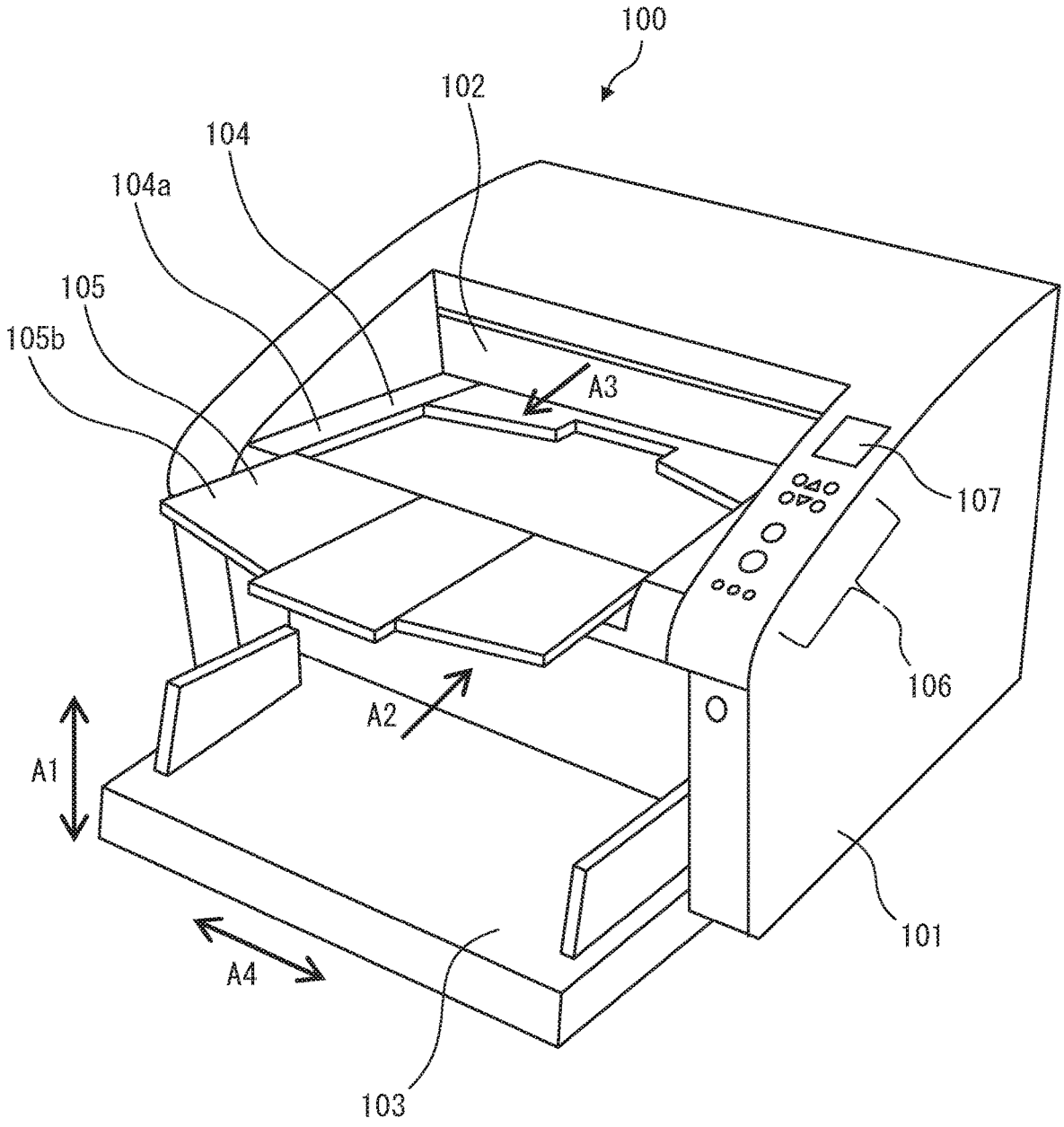
FIG. 2 is a perspective view showing a medium ejection apparatus 100.

FIG. 1 and FIG. 2 are perspective views showing a medium ejection apparatus 100 configured as an image scanner. The medium ejection apparatus 100 conveys and captures an image of a medium configured as a document. The medium is printing paper, thick paper, cards, etc. The medium ejection apparatus 100 may be a facsimile, a copier, a multifunction peripheral (MFP), etc. Note that the medium which is conveyed may not be a document, but may be some other object to be printed and the medium ejection apparatus 100 may be a printer, etc.

In FIG. 1 and FIG. 2, an arrow A1 shows an approximately vertical direction (height direction), an arrow A2 shows a medium conveyance direction, an arrow A3 shows a medium ejection direction, and an arrow A4 shows a width direction perpendicular to the medium conveyance direction A2 or a medium ejection direction A3. Below, "upstream" means upstream in the medium conveyance direction A2 or the medium ejection direction A3, while "downstream" means downstream in the medium conveyance direction A2 or the medium ejection direction A3.

The medium ejection apparatus 100 is provided with a first housing 101, second housing 102, stacking tray 103, ejection section 104, ejection tray 105, operating device 106, display device 107, etc.

The first housing 101 and second housing 102 are examples of a housing. The second housing 102 is located at the inside of the first housing 101 and pivotably engages with the first housing 101 by a hinge so as to be able to be opened and closed at the time of medium clogging, the time of cleaning the inside of the medium ejection apparatus 100, etc.

The stacking tray 103 engages with the first housing 101 to enable stacking of the medium to be conveyed. The stacking tray 103 is provided at the side surface of the first housing 101 at the medium feed side to be able to move in the height direction A1. When the medium is not being conveyed, the stacking tray 103 is located at the position of the bottom end so that the medium is easily stacked and when the medium is being conveyed, the medium stacked at the topmost side rises up to a position contacting a later explained pick roller.

The ejection section 104 is formed on the second housing 102. The ejection section 104 has a stacking surface 104*a* to stack the medium, and stacks the medium ejected from the ejection outlet of the first housing 101 and the second housing 102.

The ejection tray 105 is attached to the second housing 102 to be able to rotate. In particular, the ejection tray 105 is attached to a downstream side end part of the ejection section 104 in the medium ejection direction A3 to be able to rotate. Due to this, the ejection tray 105 is provided to be able to be opened and closed relative to the ejection section 104. The ejection tray 105, as shown in FIG. 1, is provided to be able to be accommodated on the ejection section 104 in the closed state while, as shown in FIG. 2, is provided to be able to extend the stacking surface 104*a* from the downstream side end part of the ejection section 104 in the opened state. Therefore, the medium ejection apparatus 100 can support the conveyance of a large size medium while reducing the size of the apparatus when not conveying a large size medium.

The ejection tray 105 has a first surface 105*a* and a second surface 105*b* for stacking the medium and stacks the medium ejected from the ejection outlet of the first housing 101 and the second housing 102. The second surface 105*b* is formed at the back side of the first surface 105*a*. The ejection tray 105 is provided to be able to rotate between a first position where it is accommodated on the ejection section 104 so that the ejected medium is stacked on the first surface 105*a* (FIG. 1) and a second position where it is extended from the ejection section 104 so that the ejected medium is stacked on the second surface 105*b* (FIG. 2).

When not yet used or when a small size medium (for example, a medium with a length in the medium ejection direction A3 of an A4 horizontal size or less) is ejected, the ejection tray 105 is located at the first position. Due to this, the medium ejection apparatus 100 can compact as a whole. Due to this, the medium ejection apparatus 100 can reduce the space which the apparatus occupies and sufficiently secure space for work of the user. On the other hand, if a large size medium (for example, a medium with a length in the medium ejection direction A3 of larger than the A4 horizontal size) is ejected, the ejection tray 105 is located at the second position. Due to this, the medium ejection apparatus 100 can hold the ejected large size medium well. Therefore, the medium ejection apparatus 100 can support the conveyance of a large size medium while reducing the size of the apparatus when not conveying a large size medium.

The operating device 106 has buttons or other input devices and an interface circuit for acquiring signals from the input devices, receives input operations of a user, and outputs operating signals corresponding to the input operations of a user. The display device 107 has a display including liquid crystals, organic EL's (Electro-Luminescence), etc., and an interface circuit for outputting image data to the display, to output the image data to the display. Note that the display device 107 may also be a liquid crystal display with a touch panel function. In this case, the operating device 106 has an interface circuit for acquiring input signals from the touch panel.

Figure 3:
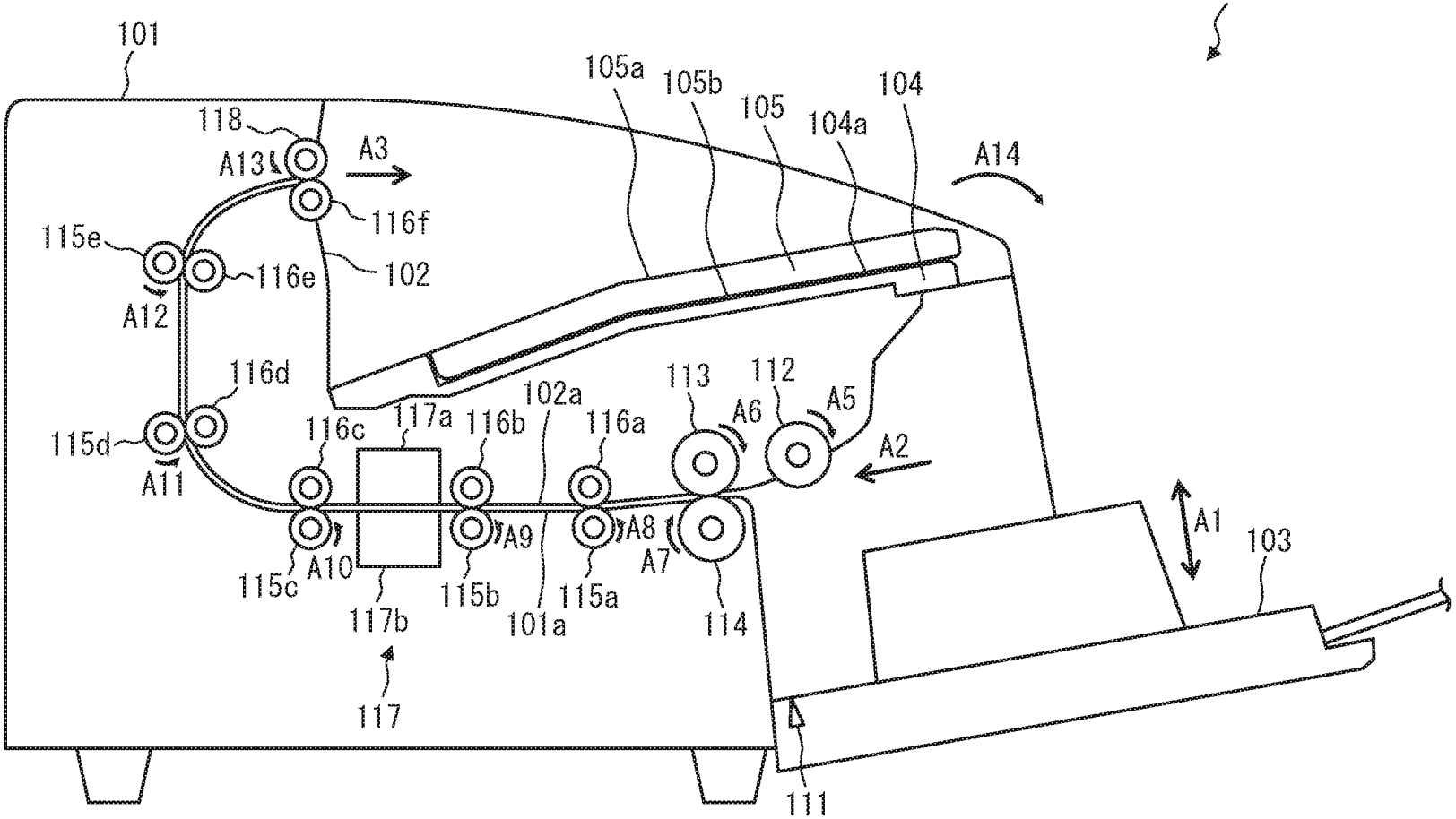
FIG. 3 is a view for explaining a conveyance route of an inside of a medium ejection apparatus 100.

FIG. 3 is a view for explaining a conveyance route at the inside of the medium ejection apparatus 100.

The conveyance route at the inside of the medium ejection apparatus 100 includes a medium sensor 111, pick roller 112, feed roller 113, separation roller 114, first to fifth conveyance rollers 115*a* to 115*e*, first to sixth driven rollers 116*a* to 116*f*, imaging device 117, ejection roller 118, etc.

Note that the pick roller 112, feed roller 113, separation roller 114, first to fifth conveyance rollers 115*a* to 115*e*, first to sixth driven rollers 116*a* to 116*f*, and/or ejection roller 118 are not limited in number to one each. Multiple ones may also be provided. In this case, the multiple feed rollers 113, separation rollers 114, first to fifth conveyance rollers 115*a* to 115*e*, first to sixth driven rollers 116*a* to 116*f*, and/or ejection rollers 118 are respectively located spaced apart in the width direction A4.

The surface of the first housing 101 facing the second housing 102 forms a first guide 101*a* of the medium conveyance path, while the surface of the second housing 102 facing the first housing 101 forms a second guide 102*a* of the medium conveyance path.

The medium sensor 111 is located at the stacking tray 103, i.e., at the upstream side of the feed roller 113 and separation roller 114, and detects the stacked state of the medium at the stacking tray 103. The medium sensor 111 determines whether the stacking tray 103 has the medium stacked on it by a contact detection sensor through which a predetermined current flows when the medium is in contact with it or the medium is not in contact with it. The medium sensor 111 generates and outputs a medium signal changing in signal value between a state where the stacking tray 103 has the medium stacked on it and a state where it does not have the medium stacked on it. Note that the medium sensor 111 is not limited to a contact detection sensor. As the medium sensor 111, a light detection sensor or any other sensor able to detect the presence of a medium may be used.

The pick roller 112 is provided at the second housing 102 and contacts the medium stacked on the stacking tray 103 risen to a height substantially equal to the medium conveyance path then feeds the medium toward the downstream side.

The feed roller 113 is provided inside the second housing 102 at the downstream side of the pick roller 112 and feeds the medium stacked on the stacking tray 103 and fed by the pick roller 112 toward the further downstream side. The separation roller 114 is provided inside the first housing 101 facing the feed roller 113. The separation roller 114 is a so-called "brake roller" and or "retard roller" and is provided rotatably in the opposite direction of the medium feed direction or stoppably. The feed roller 113 and separation roller 114 perform a separation operation of the medium and separates and feeds the medium one by one. The feed roller 113 is located at an upper side with respect to the separation roller 114. The medium ejection apparatus 100 feeds the medium by the so-called top feed system. Note that the feed roller 113 may be located at a lower side with respect to the separation roller 114, and the medium ejection apparatus 100 may feed the medium by the so-called bottom feed system as well.

The first to fifth conveyance rollers 115*a* to 115*e* and first to fifth driven rollers 116*a* to 116*e* are provided facing each other at the downstream side of the feed roller 113 and the separation roller 114 and convey the medium fed by the feed roller 113 and separation roller 114 toward the downstream side.

The imaging device 117 is located at the downstream side of the first to second conveyance rollers 115*a* to 115*b* in the medium conveyance direction A2 and captures an image of the medium conveyed by the first to second conveyance rollers 115*a* to 115*b* and the first to second driven rollers 116*a* to 116*b*. The imaging device 117 includes a first imaging device 117*a* and a second imaging device 117*b* located facing each other across the medium conveyance path.

The first imaging device 117*a* has a contact optical system type CIS (contact image sensor) line sensor having imaging elements comprised of CMOS's (complementary metal oxide semiconductors) located in a line in the main scan direction. Further, the first imaging device 117*a* has a lens for forming an image on the imaging elements and an A/D converter for amplifying the electrical signal output from the imaging elements and converting it from an analog to digital (A/D) format. The first imaging device 117*a* captures an image of the front surface of the conveyed medium to generate and output an input image.

Similarly, the second imaging device 117*b* has a contact optical system type CIS line sensor having imaging elements comprised of CMOS's located in a line in the main scan direction. Further, the second imaging device 117*b* has a lens for forming an image on the imaging elements and an A/D converter for amplifying the electrical signal output from the imaging elements and converting it from an analog to digital (A/D) format. The second imaging device 117*b* captures an image of the back surface of the conveyed medium to generate and output an input image.

Note that the medium ejection apparatus 100 may have only one of the first imaging device 117*a* and the second imaging device 117*b* and may read only one surface of the medium. Further, instead of the contact optical system type CIS line sensor provided with imaging elements comprised of CMOS's, a contact optical system type CIS line sensor provided with imaging elements comprised of CCD's (charge coupled devices) may also be utilized. Further, a reduction optical system type line sensor provided with imaging elements comprised of CMOS's or CCD's may also be used.

The ejection roller 118 and the sixth driven roller 116*f* are provided facing each other at the downstream side of the first to fifth conveyance rollers 115*a* to 115*e*. The ejection roller 118 and the sixth driven roller 116*f* eject the medium conveyed by the first to fifth conveyance rollers 115*a* to 115*e* and the first to fifth driven rollers 116*a* to 116*e* to the ejection section 104 and the ejection tray 105.

The medium stacked on the stacking tray 103 is conveyed between the first guide 101*a* and the second guide 102*a* toward the medium conveyance direction A2 by the pick roller 112 and the feed roller 113 respectively rotating in the medium feed directions A5, A6. The medium ejection apparatus 100 has, as feed modes, a separation mode for feeding the medium while separating it and a nonseparation mode for feeding the medium without separating it. The feed mode is set by a user using the operating device 106 or an information processing apparatus communicating and connected with medium ejection apparatus 100. If the feed mode is set to the separation mode, the separation roller 114 rotates in the direction of the arrow A7, i.e., the direction opposite to the medium feed direction, or stops. Due to this, feed of the medium other than the separated medium is limited (prevention of multi-feed). On the other hand, if the feed mode is set to the nonseparation mode, the separation roller 114 rotates in the opposite direction of the arrow A7, i.e., the medium feed direction.

The medium is guided by the first guide 101*a* and the second guide 102*a* while the first to the second conveyance rollers 115*a* to 115*b* rotate in the direction of the arrows A8 to A9 whereby it is fed to the imaging position of the imaging device 117 and is captured by the imaging device 117. Further, the medium is ejected on the ejection section 104 and ejection tray 105 by the third to the fifth conveyance rollers 115*c* to 115*e* and ejection roller 118 respectively rotating in the directions of the arrows A10 to A13. The ejection section 104 and the ejection tray 105 stack the medium ejected by the ejection roller 118.

Figure 4:
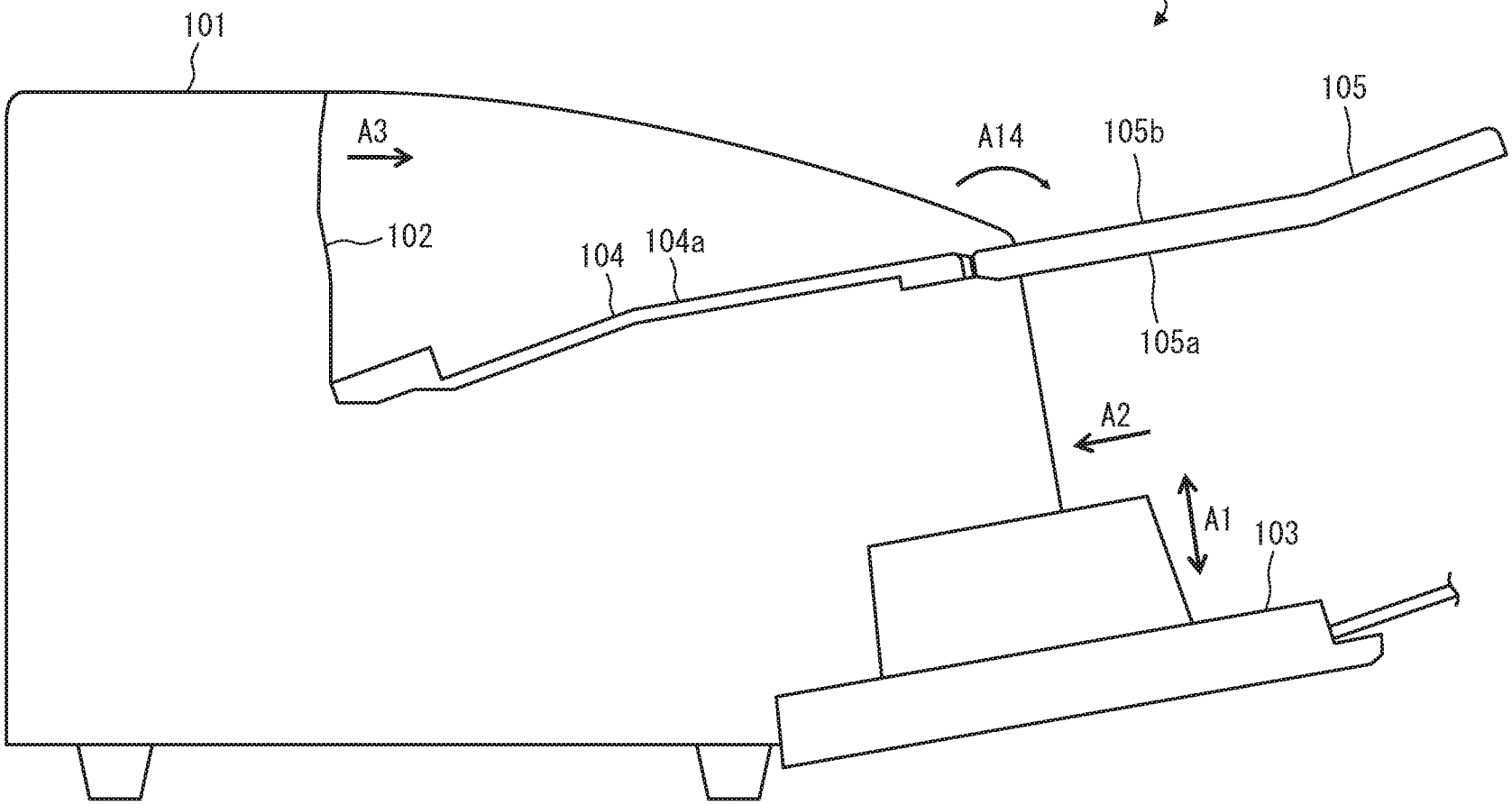
FIG. 4 is a schematic view for explaining an ejection tray 105.

FIG. 4 is a schematic view for explaining the ejection tray 105.

As shown in FIG. 3 and FIG. 4, the ejection tray 105 is attached to the downstream side end part of the ejection section 104 in the medium ejection direction A3 to be able to rotate in the direction of the arrow mark A14. The ejection tray 105 is provided to be able to rotate about a rotational axis positioned at the ejection section 104 side end part and extending in the width direction A4.

As shown in FIG. 3, at the first position, the ejection tray 105 is located so that the second surface 105*b* faces the stacking surface 104*a* of the ejection section 104 and the first surface 105*a* faces upward. On the other hand, as shown in FIG. 4, at the second position, the ejection tray 105 is located so that the second surface 105*b* faces upward and the ejection tray 105 extends the stacking surface 104*a* of the ejection section 104. If the ejection tray 105 is located at the first position, the medium ejected by the ejection roller 118 is stacked on the stacking surface 104*a* and the first surface 105*a*. On the other hand, if the ejection tray 105 is located at the second position, the medium ejected by the ejection roller 118 is stacked on the stacking surface 104*a* and the second surface 105*b*.

Figure 5:
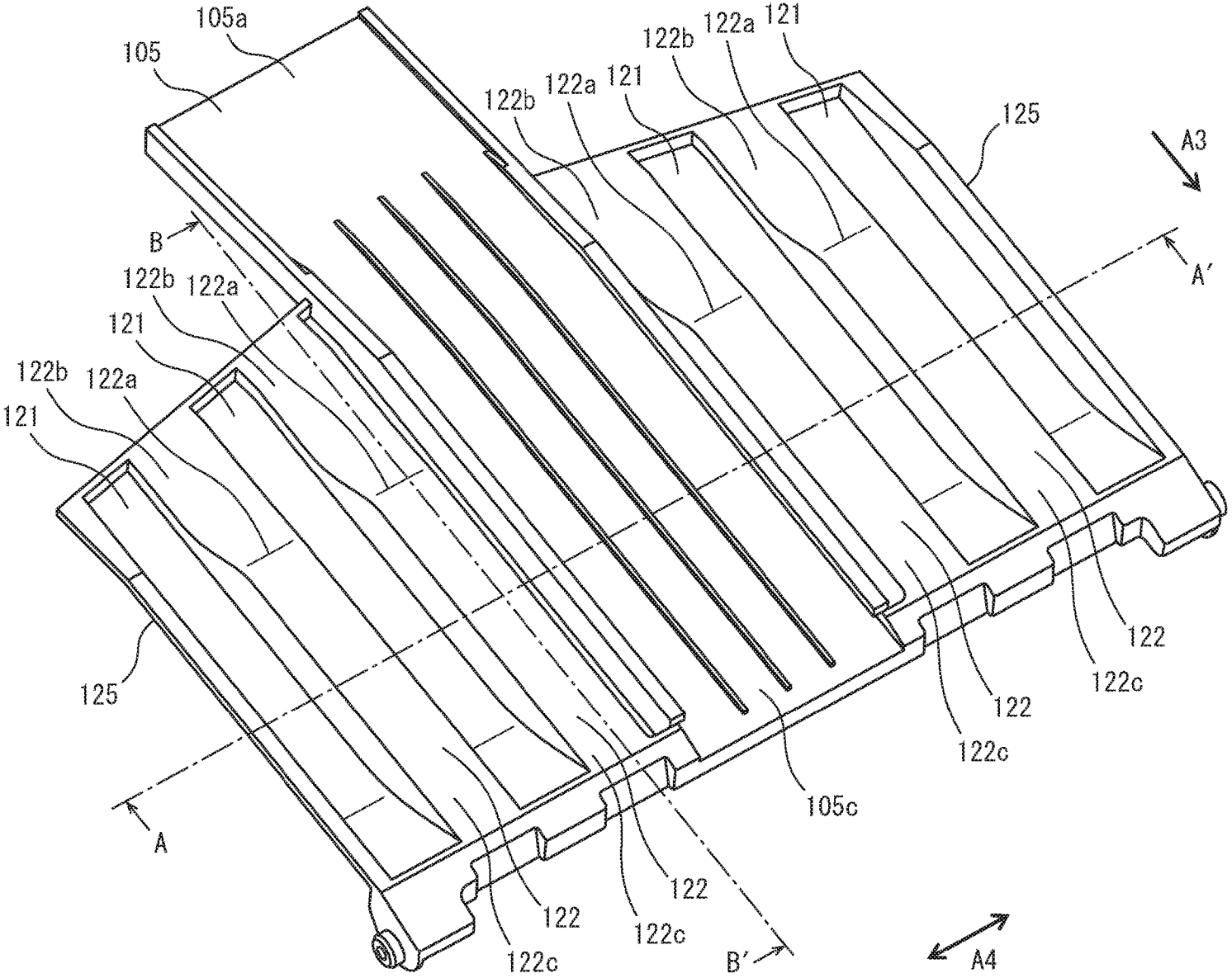
FIG. 5 is a schematic view for explaining an ejection tray 105.
Figure 6:
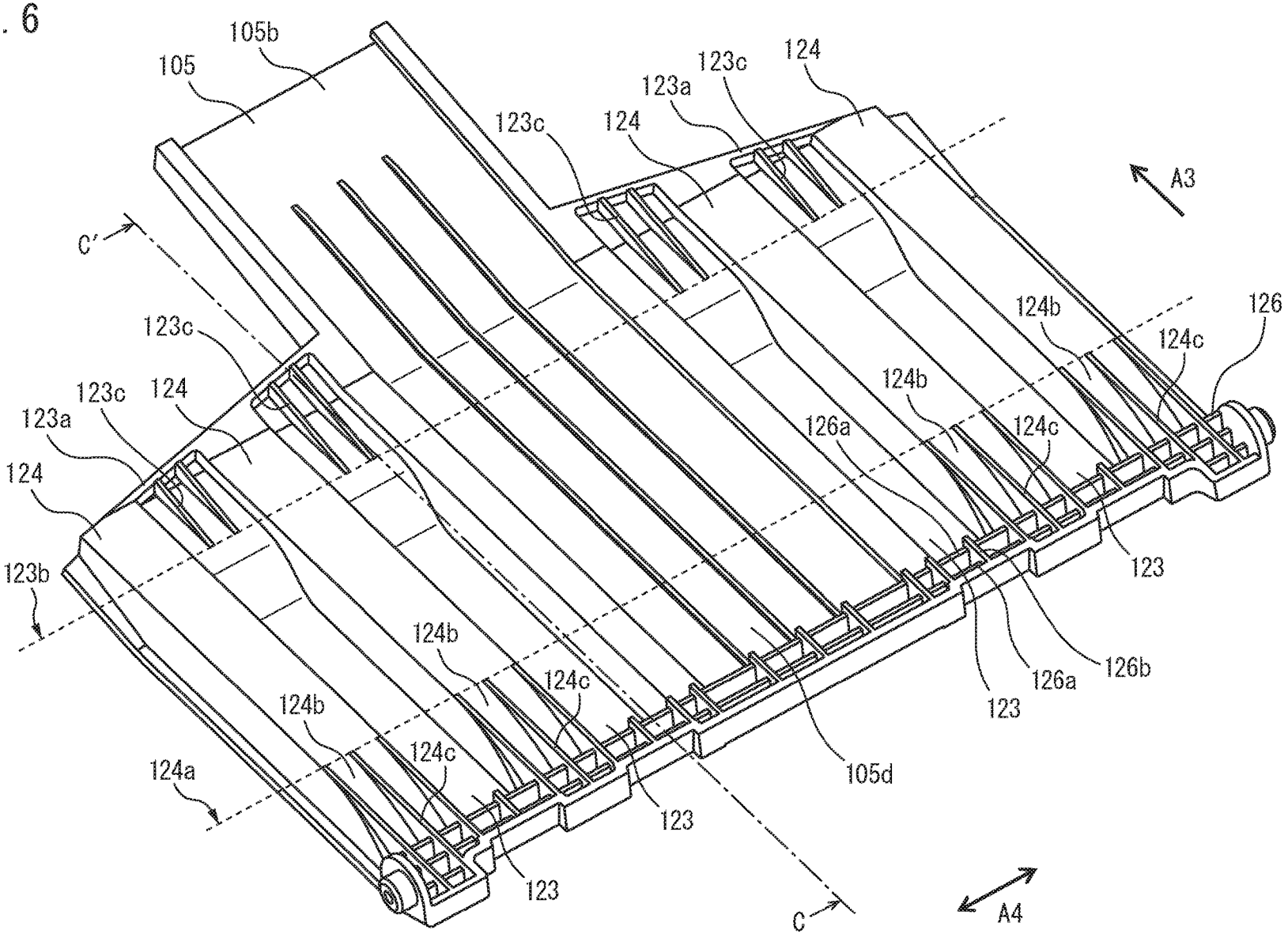
FIG. 6 is a schematic view for explaining an ejection tray 105.
Figure 7:
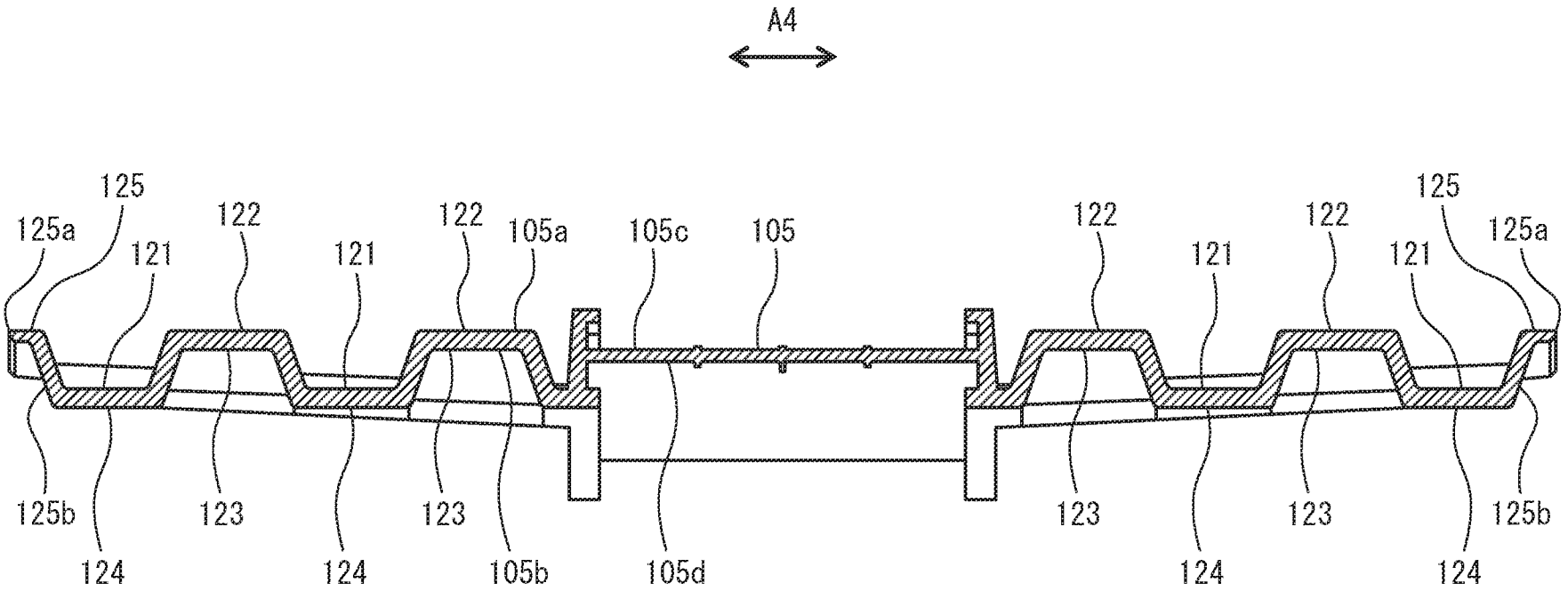
FIG. 7 is a schematic view for explaining an ejection tray 105.

FIG. 5, FIG. 6, and FIG. 7 are schematic views for explaining the ejection tray 105. FIG. 5 is a perspective view of the ejection tray 105 detached from the ejection section 104 as seen from the first surface 105*a* side. FIG. 6 is a perspective view of the ejection tray 105 detached from the ejection section 104 as seen from the second surface 105*b* side. FIG. 7 is a cross-sectional view along the line A-A' of FIG. 5.

As shown in FIG. 5 and FIG. 7, the first surface 105*a* is formed with first recessed parts 121 extending in the medium ejection direction A3 and first beam parts 122 extending in the medium ejection direction A3 and sticking out from the first recessed parts 121. In the example shown in FIG. 5 and FIG. 7, the first surface 105*a* is formed with four first recessed parts 121 and four first beam parts 122. The two ends of the first surface 105*a* in the width direction A4 are respectively formed with the first recessed parts 121. First recessed parts 121 are further respectively formed between the center part 105*c* of the first surface 105*a* and the first recessed parts 121 formed at the two ends in the width direction A4. Further, first beam parts 122 are respectively formed between the first recessed parts 121 formed at the two ends and the first recessed parts 121 formed at the insides. First beam parts 122 are further respectively formed between the center part 105*c* and the first recessed parts 121 formed at the insides.

On the other hand, as shown in FIG. 6 and FIG. 7, the second surface 105*b* is formed with second recessed parts 123 extending in the medium ejection direction A3 and is formed with second beam parts 124 extending in the medium ejection direction A3 and sticking out from the second recessed parts 123. In the example shown in FIG. 6 and FIG. 7, the second surface 105*b* is formed with four second recessed parts 123 and four second beam parts 124. The two ends of the second surface 105*b* in the width direction A4 are respectively formed with second beam parts 124. Second beam parts 124 are further respectively formed between the center part 105*d* of the second surface 105*b* and the second beam parts 124 formed at the two ends in the width direction A4. Further, second recessed parts 123 are respectively formed between the second beam parts 124 formed at the two ends and the second beam parts 124 formed at the insides. Second recessed parts 123 are further respectively formed between the center part 105*d* and the second beam parts 124 formed at the insides.

Due to the first recessed parts 121, first beam parts 122, second recessed parts 123, and second beam parts 124 being formed along the medium ejection direction A3, stiffened parts run through the ejection tray 105 along the medium ejection direction A3, so the medium ejection apparatus 100 can increase the strength of the ejection tray 105. Further, due to the first surface 105*a* and the second surface 105*b* being respectively formed with recessed parts and beam parts, the contact area of the ejected medium and a surface of the ejection tray 105 is small and the friction between the two is small. Therefore, the medium ejection apparatus 100 can smoothly move the ejected medium no matter which surface the medium is ejected to and bending or jamming of the medium can be suppressed.

As shown in FIG. 7, the first surface 105*a* and the second surface 105*b* are formed by a single member. In other words, the first surface 105*a* and the second surface 105*b* are integrally formed. No space (clearance) is present between the first surface 105*a* and the second surface 105*b*. The ejection tray 105 is made of plastic or other synthetic resin and is formed by injection molding.

The second recessed parts 123 are formed by the first beam parts 122. In other words, due to the first beam parts 122 sticking out, the second recessed parts 123 are formed at the back surfaces of the first beam parts 122. On the other hand, the second beam parts 124 are formed by the first recessed parts 121. In other words, due to the first recessed parts 121 being sunk down, the second beam parts 124 are formed at the back surfaces of the first recessed parts 121. Due to the ejection tray 105 being formed by a single member, the medium ejection apparatus 100 can reduce parts costs. Further, due to the second recessed parts 123 and the second beam parts 124 being formed by the first beam parts 122 and first recessed parts 121, the medium ejection apparatus 100 can reduce the manufacturing costs of the ejection tray 105 by injection molding. Furthermore, due to the second recessed parts 123 and the second beam parts 124 being formed by the first beam parts 122 and the first recessed parts 121, the first surface 105*a* and the second surface 105*b* have shared appearances. Due to this, the medium ejection apparatus 100 has a highly refined design with an integral feel.

Figure 8:
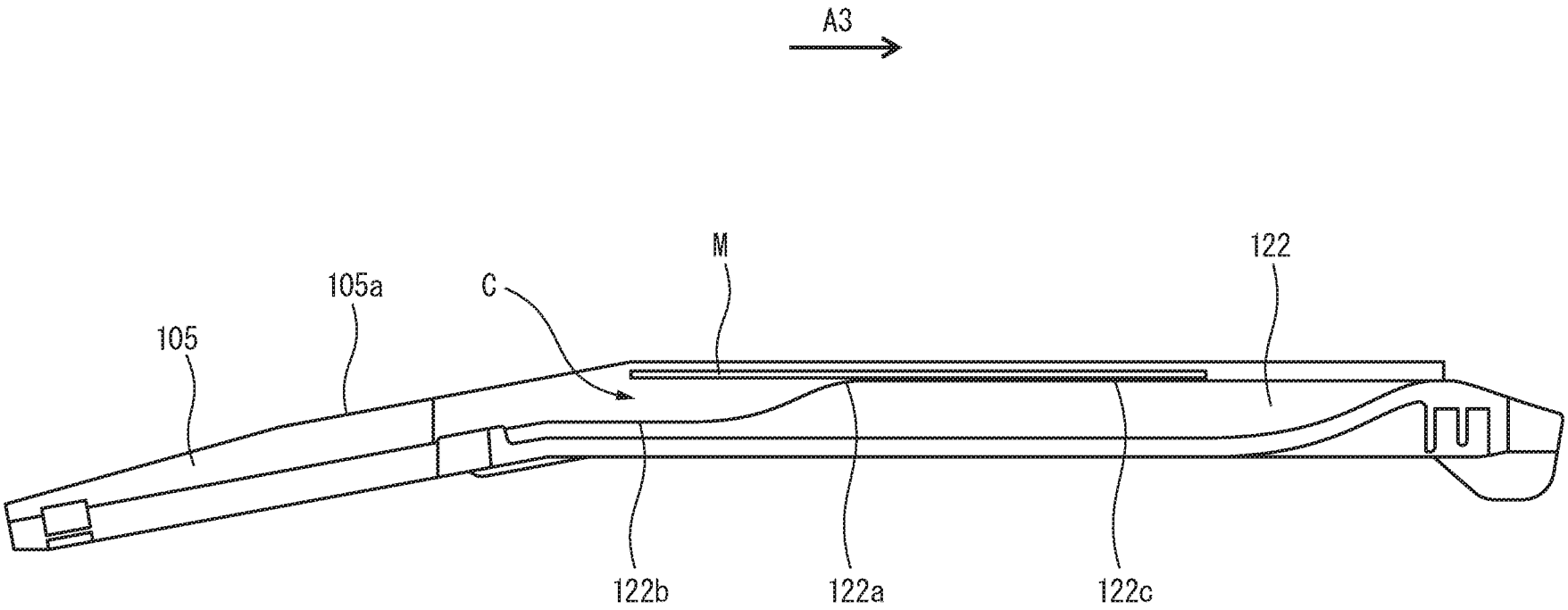
FIG. 8 is a cross-sectional view along the line B-B' of FIG. 5.

FIG. 8 is a cross-sectional view along the line B-B' of FIG. 5. FIG. 8 shows the state where a medium M is stacked on the ejection tray 105 located at the first position.

As shown in FIG. 5 and FIG. 8, a first beam part 122 is formed so that a part 122*b* at an upstream side from a first predetermined position 122*a* is sunken down from a part 122*c* at a downstream side from the first predetermined position 122*a* in the medium ejection direction A3, in a state enabling the medium to be stacked at the first surface 105*a*. In other words, a first beam part 122 has a recess at the upstream side from the first predetermined position 122*a* in a state where the ejection tray 105 is located at the first position and accommodated on the ejection section 104. The first predetermined position 122*a* is one example of a predetermined position. Due to this, a clearance C is formed between the medium M and first surface 105*a*. When a user takes out the medium from the stacking tray 103, a finger can be inserted from the upstream side to the clearance C enabling the medium to be lifted up easily and readily. Therefore, the medium ejection apparatus 100 can improve user friendliness.

Note that, the first beam parts 122 may also be formed so as not to have recesses.

Figure 9:
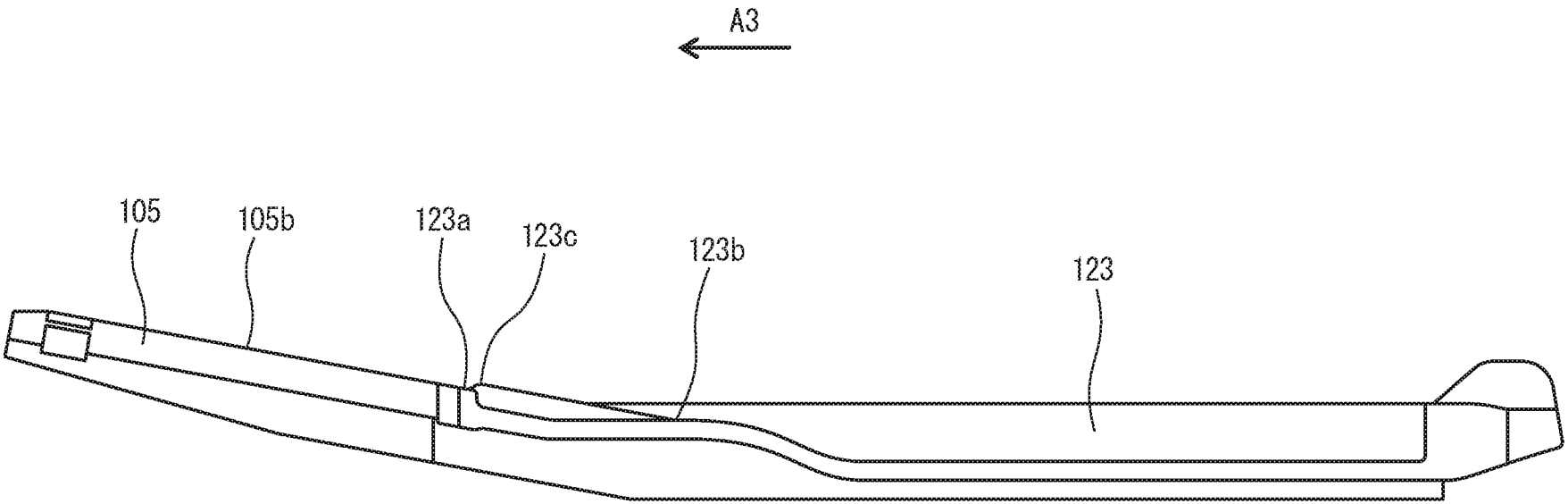
FIG. 9 is a cross-sectional view along the line C-C' of FIG. 6.

FIG. 9 is a cross-sectional view along the line C-C' of FIG. 6.

As shown in FIG. 6 and FIG. 9, the downstream ends of the second recessed parts 123 in the medium ejection direction A3 are formed with first projecting parts 123*a* in the state where the ejection tray 105 is located at the second position and the medium can be stacked on the second surface 105*b*. The first projecting parts 123*a* are one example of the projecting parts. Due to the first projecting parts 123*a*, the downstream end of the ejection tray 105 has a stiffened part running through it in the substantial width direction A4, so the medium ejection apparatus 100 can increase the strength of the ejection tray 105.

Further, the second recessed parts 123 are formed with first ribs 123*c* extending so as to gradually be higher from the second predetermined position 123*b* toward the first projecting parts 123*a* in the medium ejection direction A3. The second predetermined position 123*b* is one example of the predetermined position, while the first ribs 123*c* are one example of the ribs. The first ribs 123*c* are formed at the downstream ends of the second recessed parts 123 in the medium ejection direction A3 so as to be higher than the first projecting parts 123*a*. The first ribs 123*c* may also be formed so as to have the same heights as the first projecting parts 123*a* at the downstream ends of the second recessed parts 123 in the medium ejection direction A3. By the first ribs 123*c* being formed, in the state where the ejection tray 105 is located at the second position, it is suppressed that the front end of the ejected medium strikes the first projecting parts 123*a* and jamming of the medium occurs. Therefore, the medium ejection apparatus 100 can increase the strength of the ejection tray 105 while suppressing the occurrence of jamming of the medium.

Note that the number of the first ribs 123*c* formed at the second recessed parts 123 may be any number. Further, the first ribs 123*c* may also be omitted.

Figure 10:
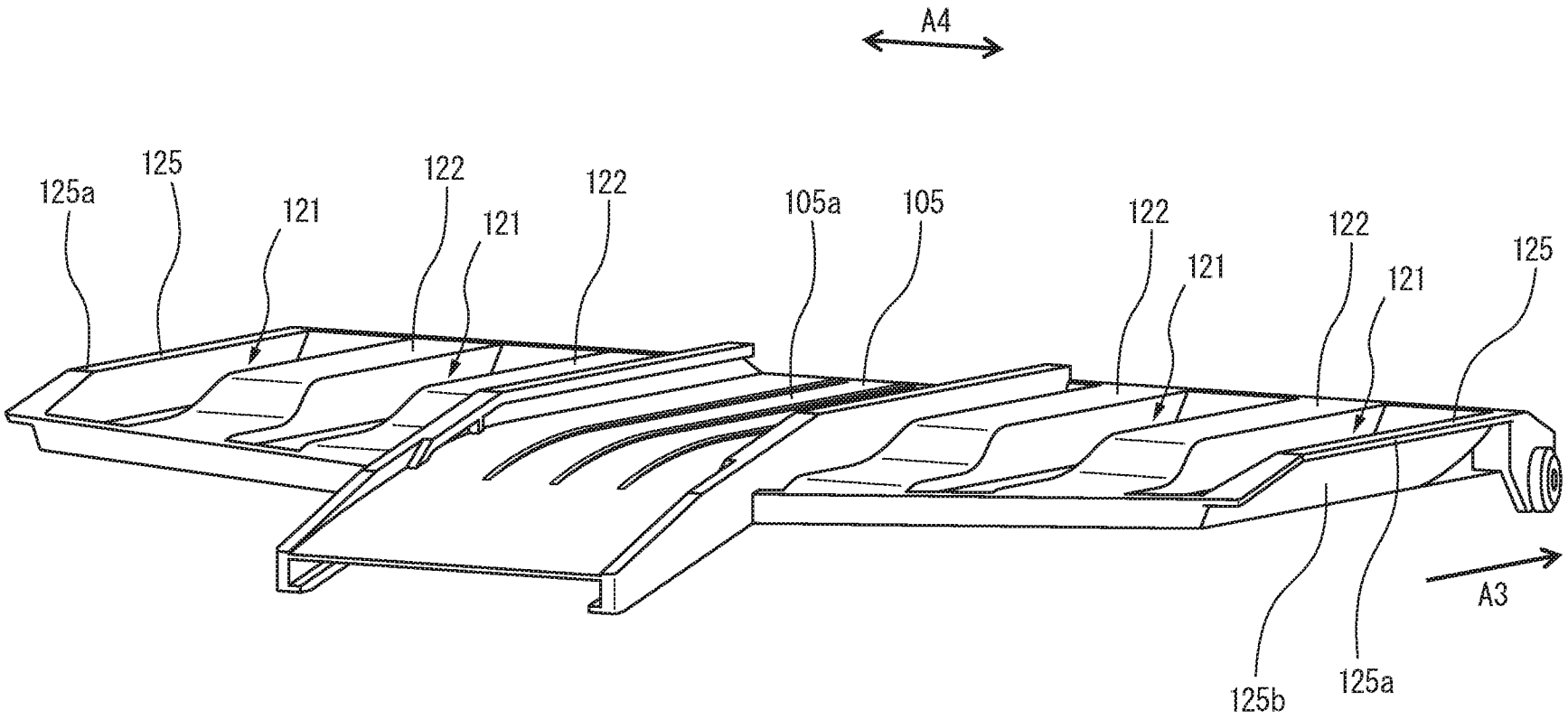
FIG. 10 is a perspective view of an ejection tray 105 located at a first position as seen from an upstream side.

FIG. 10 is a perspective view of the ejection tray 105 located at the first position as seen from the upstream side.

As shown in FIG. 5, FIG. 7, and FIG. 10, in the width direction A4 perpendicular to the medium ejection direction, the end part of the first surface 105*a* is formed with the first recessed parts 121. In the width direction A4 perpendicular to the medium ejection direction, the outside end parts 125 of the first recessed parts 121 formed at the end parts of the first surface 105*a* include projecting parts 125*a* sticking out toward the outsides. In other words, they are formed so as to stick out toward the outsides. On the other hand, at the ejection section 104, in the state where the ejection tray 105 is accommodated on the ejection section 104, recesses are formed in the vicinities of positions facing the projecting parts 125*a*. In the state where the ejection tray 105 is accommodated on the ejection section 104, a user can hook a finger around a projecting part 125*a* so as to easily and readily lift up the ejection tray 105 and locate it at the second position. Therefore, the medium ejection apparatus 100 can improve user friendliness.

Further, in the width direction A4 perpendicular to the medium ejection direction, the outside end parts 125 of the first recessed parts 121 formed at the end parts of the first surface 105*a* have outside side faces 125*b*. The outside side faces 125*b* are inclined so as to be arranged gradually toward the inside from the first surface 105*a* side to the second surface 105*b* side. In the state where the ejection tray 105 is accommodated on the ejection section 104, the outside side faces 125*b* are arranged more at the insides the further downward, so a user can insert a finger deep at an outside end part 125 and can more readily lift up the ejection tray 105 to locate it at the second position. Therefore, the medium ejection apparatus 100 can more improve user friendliness.

Note that, the outside end parts 125 of the first recessed parts 121 may also be formed so as not to have projecting parts 125*a* and/or outside side faces 125*b*.

Further, as shown in FIG. 6, the housing side end part 126 of the second surface 105*b* in the medium ejection direction A3 is formed with a plurality of second projecting parts 126*a* extending in the width direction A4 perpendicular to the medium ejection direction. Between the plurality of second projecting parts 126*a*, second ribs 126*b* extending in the medium ejection direction A3 are formed. In other words, the housing side end part 126 of the second surface 105*b* in the medium ejection direction A3 is formed with second ribs 126*b* extending in the medium ejection direction A3. The second ribs 126*b* are one example of the ribs. As explained above, the ejection tray 105 is attached to the downstream side end part of the ejection section 104 in the medium ejection direction A3 to be able to rotate. Due to the second projecting parts 126*a* and the second ribs 126*b*, the housing side end part of the ejection tray 105 serving as the rotational axis is strengthened and the occurrence of damaging the ejection tray 105 by opening and closing of the ejection tray 105 is suppressed.

Note that, the number of the second ribs 126*b* may be any number. Further, the second projecting parts 126*a* and/or the second ribs 126*b* may be omitted.

Further, the second beam parts 124 are formed with recesses 124*b* so that the second beam parts 124 is gradually lower from a third predetermined position 124*a* to the second projecting parts 126*a* in the medium ejection direction A3. The recesses 124*b* are formed with third ribs 124*c* extending in the medium ejection direction A3. The third ribs 124*c* are one example of the ribs. The third ribs 124*c* are formed at the housing side end parts of the recesses 124*b* so as to have the same heights as the second projecting parts 126*a*. Due to the third ribs 124*c*, the housing side end part of the ejection tray 105 serving as the rotational axis is strengthened and the occurrence of damaging the ejection tray 105 by opening and closing of the ejection tray 105 is suppressed.

Note that, the number of the third ribs 124*c* may be any number. Further, the recesses 124*b* and/or the third ribs 124*c* may be omitted.

Figure 11:
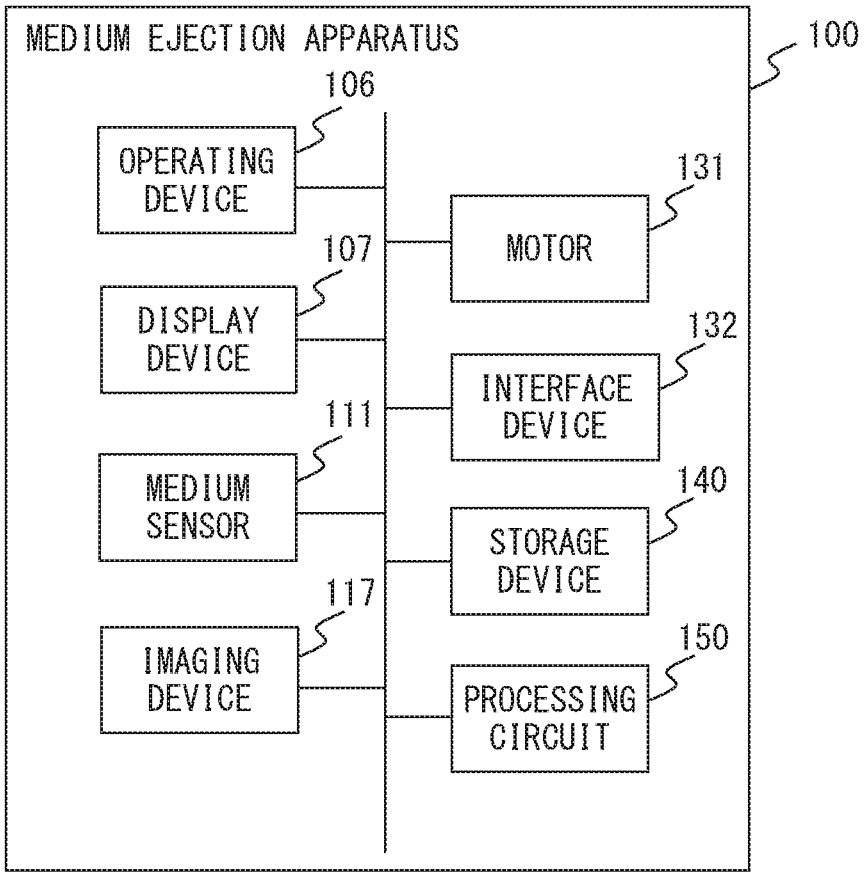
FIG. 11 is a block diagram showing a schematic constitution of a medium ejection apparatus 100.

FIG. 11 is a block diagram showing the schematic constitution of the medium ejection apparatus 100.

The medium ejection apparatus 100 further has, in addition to the above-mentioned constitution, a motor 131, interface device 132, storage device 140, processing circuit 150, etc.

The motor 131 includes one or more motors. In accordance with a control signal from the processing circuit 150, the motor 131 makes the pick roller 112, feed roller 113, separation roller 114, first to fifth conveyance rollers 115*a* to 115*e*, and/or ejection roller 118 rotate to convey the medium and cause the stacking tray 103 move. Note that the first to sixth driven rollers 116*a* to 116*f* may also be provided to not be driven to rotate by the first to fifth conveyance rollers 115*a* to 115*e* or ejection roller 118, but rotate in accordance with the drive force of the motor 131.

The interface device 132 has an interface circuit based on for example a USB or other serial bus and is electrically connected with a not shown information processing device (for example, a personal computer, mobile information terminal, etc.) to transmit and receive input images and various information. Further, instead of the interface device 132, a communication part having an antenna transmitting and receiving wireless signals and a wireless communication interface circuit for transmitting and receiving signals through a wireless communication line in accordance with a predetermined communication protocol may be used. The predetermined communication protocol is, for example, a wireless LAN (local area network). The communication part may also have a wired communication interface circuit for transmitting and receiving signals through a wire communication line in accordance with a wired LAN or other communication protocol.

The storage device 140 has a RAM (random access memory), ROM (read only memory), or other memory device, hard disk or other fixed disk device, flexible disk, optical disk, or other portable storage device, etc. Further, the storage device 140 stores computer programs, databases, tables, etc. used for various processing of the medium ejection apparatus 100. The computer programs may be installed on the storage device 140 from a computer-readable, non-transitory medium such as a CD-ROM (compact disc read only memory), DVD-ROM (digital versatile disc read only memory), etc., by using a well-known setup program etc.

The processing circuit 150 operates based on a program stored in advance in the storage device 140. The processing circuit is for example a CPU (central processing unit). As the processing circuit 150, a DSP (digital signal processor), LSI (large scale integrated circuit), ASIC (application specific integrated circuit), FPGA (field-programmable gate array), etc. may be used.

The processing circuit 150 is connected to the operating device 106, display device 107, medium sensor 111, imaging device 117, motor 131, interface device 132, storage device 140, etc. and controls these parts. The processing circuit 150 performs control for driving the motor 131, control for imaging of the imaging device 117, etc., based on the medium signal received from the medium sensor 111. The processing circuit 150 acquires an input image from the imaging device 117 and sends it through the interface device 132 to the information processing device.

Figure 12:
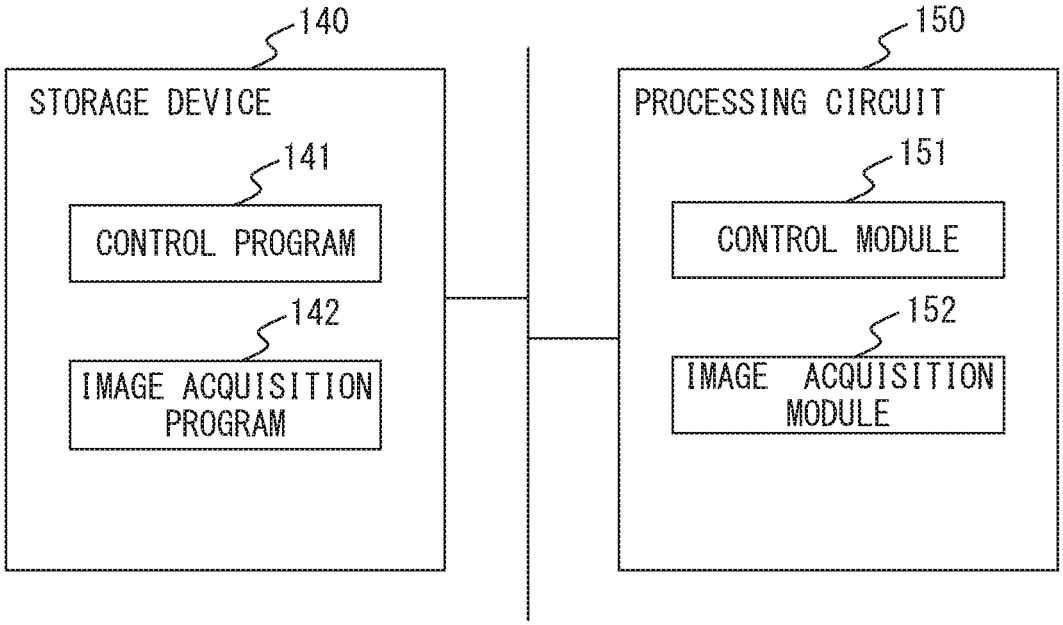
FIG. 12 is a view showing a schematic constitution of a storage device 140 and processing circuit 150.

FIG. 12 is a view showing the schematic constitution of the storage device 140 and processing circuit 150.

As shown in FIG. 12, the storage device 140 stores the control program 141, image acquisition program 142, etc. These programs are function modules loaded by software operating on a processor. The processing circuit 150 reads the programs stored in the storage device 140 and operates in accordance with the read programs. Due to this, the processing circuit 150 functions as a control module 151 and image acquisition module 152.

Figure 13:
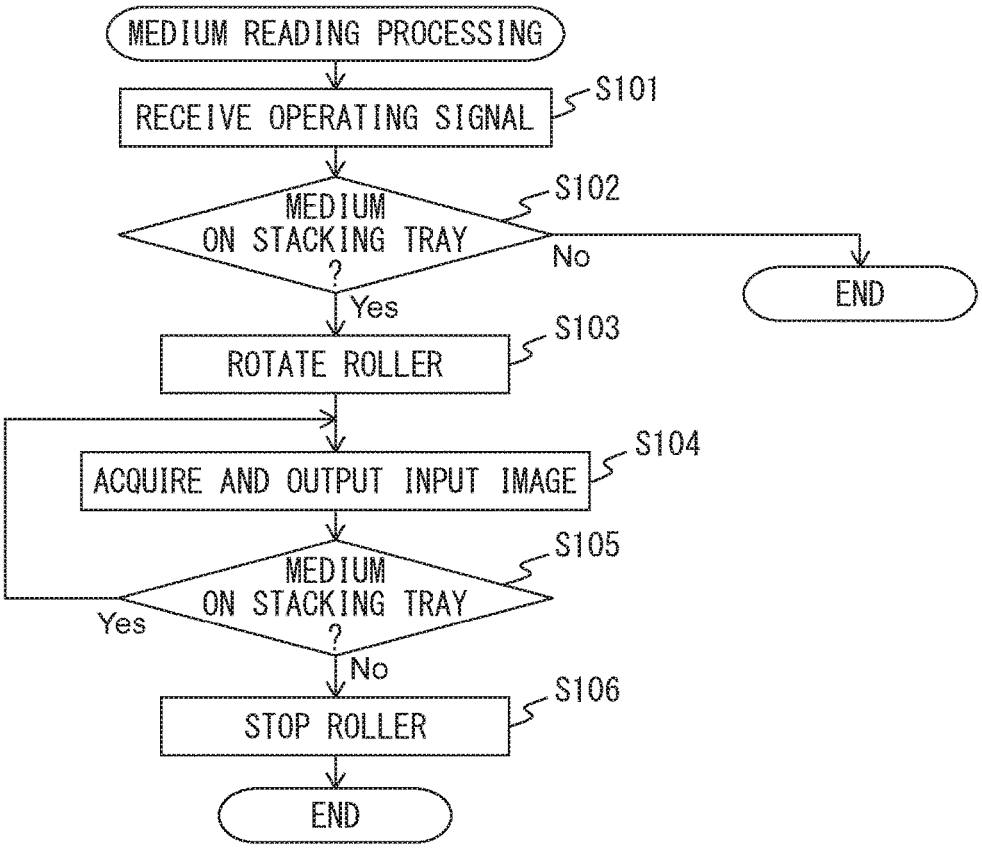
FIG. 13 is a flow chart showing an example of an operation of medium reading processing.

FIG. 13 is a flow chart showing an example of operation of the medium reading processing of the medium ejection apparatus 100.

Below, referring to the flow chart shown in FIG. 13, an example of operation of the medium reading processing of the medium ejection apparatus 100 will be explained. Note that the flow of operation explained below is performed mainly by the processing circuit 150 in cooperation with the elements of the medium ejection apparatus 100*c* based on a program stored in the storage device 140 in advance.

First, the control module 151 stands by until receiving an instruction for reading a medium from a user using the operating device 106 or information processing apparatus and receiving an operating signal for instructing reading of the medium from the operating device 106 or interface device 132 (step S101).

Next, the control module 151 acquires a medium signal from the medium sensor 111 and determines whether the stacking tray 103 has the medium stacked on it, based on the acquired medium signal (step S102). If the stacking tray 103 has the medium stacked on it, the control module 151 ends the series of steps.

On the other hand, if the medium is stacked on the stacking tray 103, the control module 151 drives the motor 131 to make the stacking tray 103 rise to a position able to feed the medium and makes the rollers rotate to make them feed and convey the medium (step S103).

Next, the control module 151 makes the imaging device 117 capture an image of the medium, acquires the input image from the imaging device 117, and transmits the acquired input image through the interface device 132 to the information processing apparatus to output it (step S104).

Next, the control module 151 determines whether the stacking tray 103 has the medium remaining on it, based on the medium signal received from the medium sensor 111 (step S105). If the stacking tray 103 has the medium remaining on it, the control module 151 returns the processing to step S104 and repeats the processing of steps S104 to S105.

On the other hand, if the stacking tray 103 has no medium remaining on it, the control module 151 controls the motor 131 so as to make the rollers stop (step S106) and ends the series of steps.

As explained in detail above, in the medium ejection apparatus 100, due to the first recessed parts 121 and first beam parts 122 formed at one surface of the ejection tray 105 which is provided to be able to rotate, the second beam parts 124 and the second recessed parts 123 are formed at the back surface. Due to this, the medium ejection apparatus 100 can switch surfaces stacking the medium on the ejection tray 105 in accordance with the type or size of the conveyed medium while having a shared appearance of the surfaces to have a highly refined design with an integral feel. Therefore, the medium ejection apparatus 100 has a high design sense which enabling several types or sizes of the medium to be suitably stacked on the ejection tray 105.

In general, the ejection tray of the medium ejection apparatus is formed by a plastic member of a thickness of 2 mm or so in order to try to reduce the weight of the device. For example, if the ejection tray is formed into a flat plate shape, the ejection tray does not have sufficient strength and may be bent or broken due to the weight of the medium when a large amount of the medium are stacked. In the medium ejection apparatus 100, the ejection tray 105 is provided with beams running along the medium ejection direction A3. Due to this, the medium ejection apparatus 100 can improve the strength of the ejection tray 105 and stack a large amount of the medium on the ejection tray 105 all together.

Figure 14:
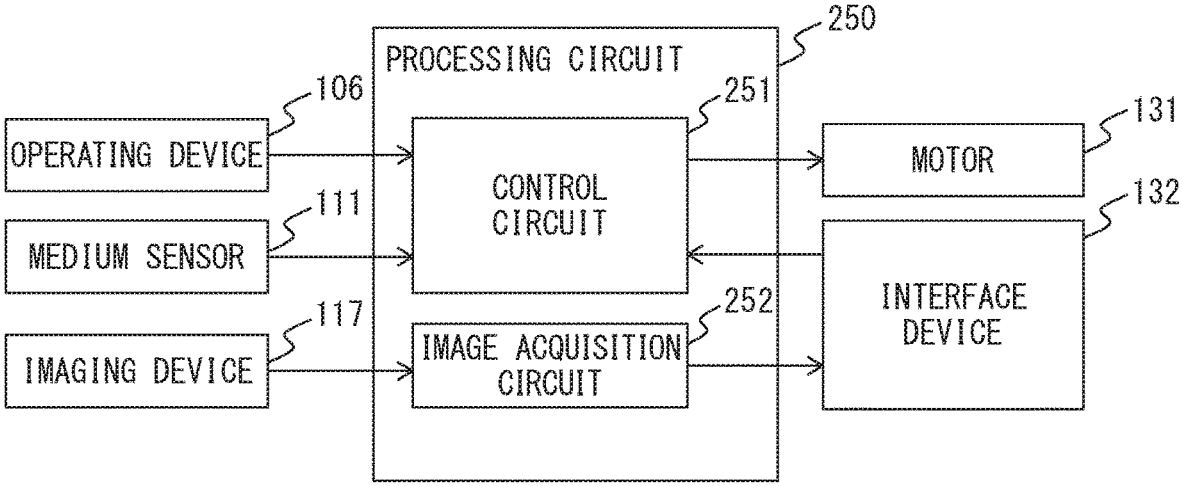
FIG. 14 is a view showing a schematic constitution of a processing circuit 250 according to another embodiment.

FIG. 14 is a view showing the schematic constitution of a processing circuit 250 of a medium ejection circuit 350 of a medium ejection apparatus according to another embodiment.

The processing circuit 250 is used in place of the processing circuit 150 of the medium ejection apparatus 100 and performs medium reading processing etc. in place of the processing circuit 150. The processing circuit 250 has a control circuit 251, image acquisition circuit 252, etc. Note that these parts may also be configured by respectively independent integrated circuits, microprocessors, firmware, etc.

The control circuit 251 is one example of a control module and has a function similar to the control module 151. The control circuit 351 receives an operating signal from the operating device 106 or interface device 132 and a medium signal from the medium sensor 111. The control circuit 251 controls the motor 131, based on the various received information.

The image acquisition circuit 252 is one example of an image acquisition module and has a function similar to the image acquisition module 152. The image acquisition circuit 252 receives an input image from the imaging device 117 and outputs it to the interface device 132.

As explained in detail above, the ejection apparatus has a high design sense which enabling several types or sizes of the medium to be suitably stacked on the ejection tray 105, even if using the processing circuit 250.

According to the present invention, the medium ejection apparatus has a high design sense while enabling several types or sizes of a medium to be suitably stacked on an ejection tray.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiment(s) of the present inventions have been described in detail, it should be understood that various changes, substitutions, and alterations can be made hereto without departing from the spirit and scope of the invention.

What is claimed is:

1. A medium ejection apparatus comprising:

a housing;

an ejection roller to eject a medium in a medium ejection direction; and an ejection tray attached to the housing to be able to rotate and having a first surface and a second surface, formed at a back side of the first surface, the ejection tray configured to stack the medium ejected by the ejection roller; wherein the first surface is formed with a first recessed part extending in the medium ejection direction and a first beam part extending in the medium ejection direction and protruding from the first recessed part, wherein the second surface is formed with a second recessed part extending in the medium ejection direction and a second beam part extending in the medium ejection direction and protruding from the second recessed part, and wherein the first beam part is formed so that a part at an upstream side from a predetermined position in the medium ejection direction is sunken down further than a part at a downstream side from the predetermined position in the medium ejection direction in a state enabling the medium to be stacked on the first surface.

2. The medium ejection apparatus according to claim 1, wherein the housing includes an ejection section of the medium, and wherein the ejection tray is attached to a downstream side end part of the ejection section in the medium ejection direction to be able to rotate.

3. The medium ejection apparatus according to claim 1, wherein a projecting part is formed at a downstream end of the second recessed part in the medium ejection direction in a state enabling the medium to be stacked on the second surface, and wherein a rib extending in the medium ejection direction so as to gradually become higher from a predetermined position toward the projecting part is formed on the second recessed part.

4. The medium ejection apparatus according to claim 1, wherein the first recessed part is formed at an end part of the first surface in a direction perpendicular to the medium ejection direction, and wherein an outside end part of the first recessed part formed at the end part of the first surface in the direction perpendicular to the medium ejection direction is formed so as to protrude toward the outside of the housing.

5. The medium ejection apparatus according to claim 4, wherein an outside side face of the first recessed part formed at the end part of the first surface in the direction perpendicular to the medium ejection direction is inclined so as to be arranged gradually toward the inside from the first surface side to the second surface side.

6. The medium ejection apparatus according to claim 1, wherein a rib extending in the medium ejection direction is formed at a housing side end part of the second surface in the medium ejection direction.

* * * * *